US010683163B2

(12) United States Patent
Behrmann et al.

(10) Patent No.: US 10,683,163 B2
(45) Date of Patent: Jun. 16, 2020

(54) SOLID WASTE BAG UNIT AND ANALYZER COMPRISING SOLID WASTE BAG UNIT

(71) Applicant: Roche Molecular Systems, Inc., Pleasanton, CA (US)

(72) Inventors: Lennart Behrmann, Zürich (CH); Stefan Brändli, Zürich (CH); Thomas Knecht, Baden (CH); André Peter, Meggen (CH)

(73) Assignee: Roche Molecular Systems, Inc., Pleasanton, CA (US)

( * ) Notice: Subject to any disclaimer, the term of this patent is extended or adjusted under 35 U.S.C. 154(b) by 157 days.

(21) Appl. No.: 15/497,958

(22) Filed: Apr. 26, 2017

(65) Prior Publication Data

US 2017/0313505 A1 Nov. 2, 2017

(30) Foreign Application Priority Data

Apr. 27, 2016 (EP) ..... 16167271

(51) Int. Cl.

| | |
|---|---|
| ***B65F 1/00*** | (2006.01) |
| ***B01L 1/00*** | (2006.01) |
| ***B65F 1/14*** | (2006.01) |
| ***B65F 1/06*** | (2006.01) |
| ***B65F 1/08*** | (2006.01) |

(52) U.S. Cl.

CPC ..... *B65F 1/0006* (2013.01); *B01L 1/50* (2013.01); *B65F 1/06* (2013.01); *B65F 1/08* (2013.01); *B65F 1/1415* (2013.01); *B01L 2300/123* (2013.01); *B65F 2220/1063* (2013.01)

(58) Field of Classification Search

CPC .. B65F 1/0006; B65F 1/06; B65F 1/08; B65F 1/1415; B65F 2220/1063; B01L 1/50

USPC ..... 383/121, 119, 104, 121.1

See application file for complete search history.

(56) References Cited

U.S. PATENT DOCUMENTS

| | | | | |
|---|---|---|---|---|
| 2,678,768 A | | 5/1954 | Vergobbi et al. | |
| 3,917,107 A | * | 11/1975 | Bottas | B30B 9/3003 100/229 A |
| 4,407,191 A | * | 10/1983 | Brenner | B30B 9/3007 100/229 A |
| 4,422,548 A | * | 12/1983 | Cheesman | A61B 5/02042 177/1 |
| 4,478,332 A | * | 10/1984 | Wiestmiller | A61B 5/02042 141/114 |
| 4,534,489 A | * | 8/1985 | Bartlett | B65D 5/60 206/459.5 |
| 4,622,693 A | * | 11/1986 | Mykleby | B65D 77/003 229/164.1 |

(Continued)

FOREIGN PATENT DOCUMENTS

| | | |
|---|---|---|
| DE | 4322702 A1 | 1/1995 |
| FR | 2759675 A1 | 8/1998 |

OTHER PUBLICATIONS https://www.hamiltoncompany.com/products/automated-liquid-handling/consumables/other-consumables/waste-bags.
http://www.sharpsdisposal.com/medical-waste-disposal/#.
Search Report for EP16167271.2 dated Jul. 11, 2016.

*Primary Examiner* — Jes F Pascua
(74) *Attorney, Agent, or Firm* — Pamela C. Ancona

(57) ABSTRACT

A solid waste bag unit for solid waste of an analyzer is disclosed. The solid waste bag unit comprises a bag, and an insert, wherein the insert is arranged within the bag. Further, an analyzer and a method for removing solid waste of an analyzer are disclosed.

6 Claims, 5 Drawing Sheets

(56) References Cited

U.S. PATENT DOCUMENTS

| | | | | |
|---|---|---|---|---|
| 4,662,516 | A * | 5/1987 | Baker, Sr. | A61L 11/00 206/363 |
| 4,978,028 | A * | 12/1990 | George | A61B 50/36 206/366 |
| 5,028,147 | A | 7/1991 | Graham | |
| 5,094,547 | A * | 3/1992 | Graham | B65D 33/02 220/908.1 |
| 5,227,765 | A * | 7/1993 | Ishizuka | A61B 5/02042 250/223 R |
| 5,629,498 | A * | 5/1997 | Pollock | G01G 17/04 177/15 |
| 5,641,947 | A * | 6/1997 | Riddle, Jr. | B65F 1/06 177/124 |
| 6,073,372 | A | 6/2000 | Davis | |
| 8,357,538 | B2 | 1/2013 | Self et al. | |
| 8,704,178 | B1 * | 4/2014 | Pollock | A61B 50/10 250/336.1 |
| 8,969,072 | B2 | 3/2015 | Robinson et al. | |
| 2003/0136787 | A1 | 7/2003 | Singuillo | |
| 2015/0168207 | A1 * | 6/2015 | Pollock | G01G 19/387 177/1 |

* cited by examiner

SOLID WASTE BAG UNIT AND ANALYZER COMPRISING SOLID WASTE BAG UNIT

CROSS-REFERENCE TO RELATED APPLICATION

The present application claims the benefit of priority under 35 U.S.C. § 119(a) of EP16167271.2, filed Apr. 27, 2016, the entire disclosure of which is hereby incorporated by reference.

FIELD OF THE DISCLOSURE

The present disclosure relates to a solid waste bag unit for solid waste of an analyzer and to an analyzer comprising a solid waste bag unit.

RELATED ART

Modern analyzers are based on automated sample processing systems that permit high-throughput specimen processing. Such systems permit not only greatly increased sample processing throughput, but decrease the number of samples that can not be analyzed, decrease the need for manual labor and allow for productive use of an operator's "walk-away time" during sample processing.

U.S. Pat. No. 8,357,538 B2 discloses an automated assay in the form of a pre-analytic system. The system used a plurality of consumables during operation such as pipetting tips and pipette racks. The racks may be deposited into one or more solid waste containers once all of the pipettes are removed. In addition, used pipettes may be deposited in the racks before they are discarded to minimize solid waste volume. Usually a solid waste bag is inserted into the container to receive the solid waste.

Using such automates analyzers provides advantages concerning the handling. Nevertheless, there are still some drawbacks. Single use waste bags for solid waste in analyzers have limited functionality: The robustness is limited and folds of the bag reduce the volume. There is a correlation as the thicker the material is, the more rigid the whole bag is and as a consequence the less volume is available. As an alternative, cardboard boxes with bags inside are better regarding volume, but the bag inside may get perforated by sharp edged consumables and liquid may drop out as only the side wall portions are made out of cardboard and bottom is not.

It is therefore an objective of the present disclosure to provide an improved solid waste bag unit and an analyzer comprising such an improved solid waste bag unit.

SUMMARY OF THE DISCLOSURE

This problem is solved by a solid waste bag unit and an analyzer having the features described herein. Accordingly, the disclosure provides a solid waste bag unit for solid waste of an analyzer, comprising a bag, and an insert, wherein the insert is arranged within the bag. The following additional and/or alternative embodiments of the unit are contemplated herein:

- the insert is foldable such that the solid waste bag unit is foldable with a minimal volume;
- the bag is made of a flexible material;
- the insert comprises a front wall portion, a rear wall portion, and two side wall portions, wherein the front wall portion and the rear wall portion are opposing to one another in an unfolded state, wherein the two side wall portions are opposing to one another in the unfolded state; and/or the front wall portion and the rear wall portion are each connected to the side wall portions by means of connecting wall portions;
- the insert further comprises a bottom portion, wherein the insert is foldable such that the front wall portion and the rear wall portion are disposed on the bottom portion and the side wall portions are disposed adjacent to the bottom portion in a folded state;
- the insert includes a front wall portion, the rear wall portion and the side wall portions are moveable from a folded position to an unfolded position by means of pushing a central portion of the bottom portion;
- the insert includes a front wall portion and the rear wall portion respectively comprise a recess, wherein the recesses form an opening in a folded state of the insert, wherein the central portion of the bottom portion is exposed through the opening in the folded state; the recesses can be rectangular, polygonal or semicircular;
- the insert comprises a substantially flat octagonal shape in a folded state;
- the bag comprises an upper portion and a lower portion, wherein the upper portion comprises an opening, wherein the insert is arranged at the lower portion.
- the bag further comprises a bottom opposing the opening, wherein the insert is arranged at the bottom;
- the insert is fixed to the bag, optionally with glue,
- the bag is made of an autoclavable material, wherein the insert is made of a cardboard or plastic material;
- the solid waste bag unit is made of an autoclavable material, wherein the insert is made of a cardboard or plastic material; and/or
- the insert is a box.

Also provided in the disclosure is an analyzer comprising an analytical device configured to use a consumable, and a solid waste bag unit as described herein. The following additional and/or alternative embodiments of the analyzer are contemplated herein:

- the analyzer includes a compartment, wherein the solid waste bag unit is placed within the compartment; the compartment comprises an insertion opening through which the solid waste bag unit is placed within the compartment, and/or the compartment can be a frame;
- the analyzer also includes a compartment as described herein and a casing configured to at least partially house the analytical device, wherein the compartment is arranged within or adjacent to the casing; the compartment can optionally be formed substantially as a hollow block, e.g., a block formed substantially cylindrical or rectangular;
- the insert is dimensioned to accurately fit or snug fit into the compartment; and/or
- the analyzer also includes a sensor configured to detect a filling state of the solid waste bag unit.

Additionally, the disclosure also contemplates a method for removing solid waste of an analyzer, comprising providing a solid waste bag unit as described herein, placing the solid waste bag unit in a compartment of the analyzer, collecting solid waste within the solid waste bag unit, removing solid waste by means of removing the solid waste bag unit from the compartment when the solid waste bag unit is at least partially filled. If the insert is foldable, wherein the insert is in a folded state when the solid waste bag unit is provided, the method can further comprise unfolding the insert. Moreover, in the method described herein the insert can be unfolded when the solid waste bag unit is placed in the compartment.

BRIEF DESCRIPTION OF THE FIGURES

Further features and embodiments of the disclosure may be disclosed in more detail in the subsequent description of embodiments, preferably in conjunction with the dependent claims. Therein, the respective features may be realized in an isolated fashion as well as in any arbitrary feasible combination as the skilled person may realize. The embodiments are schematically depicted in the figures. Therein, identical reference numbers in these figures refer to identical elements or functionally identical elements.

DETAILED DESCRIPTION OF THE EMBODIMENTS

Figure 1:
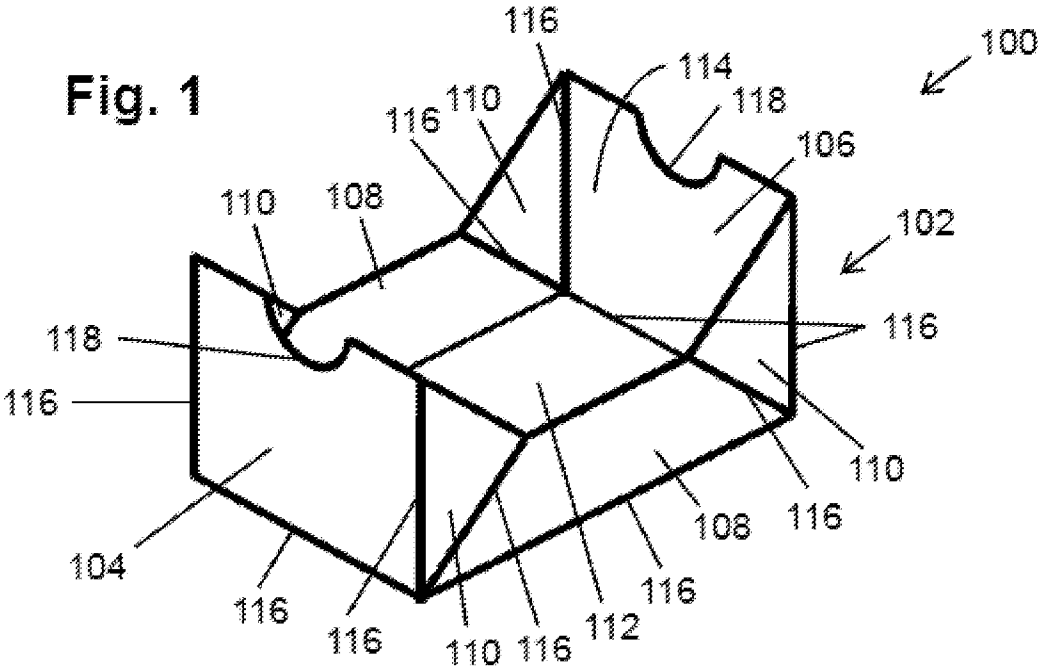
FIG. 1 shows a perspective view of an insert.

As used in the following, the terms "have," "comprise" or "include" or any arbitrary grammatical variations thereof are used in a non-exclusive way. Thus, these terms may both refer to a situation in which, besides the feature introduced by these terms, no further features are present in the entity described in this context and to a situation in which one or more further features are present. As an example, the expressions "A has B," "A comprises B," and "A includes B" may both refer to a situation in which, besides B, no other element is present in A (i.e. a situation in which A solely and exclusively consists of B) and to a situation in which, besides B, one or more further elements are present in entity A, such as element C, elements C and D or even further elements.

Further, it shall be noted that the terms "at least one," "one or more," or similar expressions indicating that a feature or element may be present once or more than once typically will be used only once when introducing the respective feature or element. In the following, in most cases, when referring to the respective feature or element, the expressions "at least one" or "one or more" will not be repeated, non-withstanding the fact that the respective feature or element may be present once or more than once.

The term "bag" as used herein refers to any kind of bag configured to receive solid waste of an analyzer such as a laboratory instrument.

The term "solid waste" as used herein refers to any kind of waste in a solid state resulting from consuming a consumable of an analyzer. Such consumables are pipetting tips, racks, sample vessels or the like which are disposable or single-use products.

The term "insert" as used herein refers to any kind of container configured to receive solid waste. Particularly, the inset is made of a material configured to resist perforation from any sharp solid waste.

According to the present disclosure, a solid waste bag unit for solid waste of an analyzer comprises a bag and an insert, wherein the insert is arranged within the bag. Thus, the insert is configured to protect the bag from being perforated by any solid waste inserted into the solid waste bag unit as the solid waste does not come into contact with the bag at critical portions such as the bottom and lower sides of the bag. Needless to say, as the insert might come into contact with any liquids adhering to the solid waste, the insert has to be resistant to liquids and has to be protected from being disintegrated by liquids, respectively.

The insert may be foldable. Thus, the combination of bag and insert may be distributed and stored in a compact manner if the insert is in the folded state. Further, the insert may be unfolded right before being used. Therefore, the solid waste bag unit is easy to handle.

The bag may be made of a flexible material. Thus, the bag may be compacted and expanded on demand.

Particularly, the insert may be foldable such that the solid waste bag unit is foldable with a minimal volume. Thus, before being used, the solid waste bag unit is as small as possible which facilitates transporting and storing thereof.

The insert may comprise a front wall portion, a rear wall portion, and two side wall portions, wherein the front wall portion and the rear wall portion are opposing to one another in an unfolded state, wherein the two side wall portions are opposing to one another in the unfolded state. Thus, the insert may be arranged in an ashlar-formed or rectangular shape which is stable during use as the walls of the insert provide rigidity to the solid waste bag unit.

The front wall portion and the rear wall portion may be each connected to the side wall portions by means of connecting wall portions. Thus, all walls transition into one another and the insert does not comprises any gaps through which solid waste might damage the bag at those portions covered by the insert.

The insert may further comprise a bottom portion, wherein the insert may be foldable such that the front wall portion and the rear wall portion are disposed on the bottom portion and the side wall portions are disposed adjacent to the bottom portion in a folded state. Thus, the insert may be folded into a shape which is very compact.

The front wall portion, the rear wall portion and the side wall portions may be moveable from a folded position to an unfolded position by means of pushing a central portion of the bottom portion. Thus, the insert may be unfolded with a single operation or hand movement.

The front wall portion and the rear wall portion may respectively comprise a recess, wherein the recesses may form an opening in a folded state of the insert, wherein the central portion of the bottom portion may be exposed through the opening in the folded state. Thus, the central portion may be easily pushed through the opening.

The recesses may be formed rectangular, polygonal or semicircular. Thus, the recesses and, consequently, the opening may be individually shaped such that the handling of the insert may be adapted to the respective application.

The insert may comprise a substantially flat octagonal shape in a folded state. Thus, the folding lines of the insert may be designed so as to improve the operability of the insert.

The bag may comprise an upper portion and a lower portion, wherein the upper portion may comprise an opening, wherein the insert may be arranged at the lower portion. In other words, the bag may comprise an upper half and a lower half. Particularly, the probability for the bag to be damaged by solid waste is significantly higher at the lower portion than at the upper portion because the pressure on the bag due to the weight of the solid waste increases from the top to the bottom of the bag. Thus, regarding most applications, it is sufficient for the insert to be arranged at the lower portion or half in order to reliably protect the bag.

The bag may further comprise a bottom opposing the opening, wherein the insert is arranged at the bottom. Thus, the most critical portion of the bag is reliably protected by the insert.

The insert may be fixed to the bag. Thus, the insert may be prevented from being moved relative to the bag which might expose any critical portions of the bag which might be damaged.

The insert may be fixed to the bag with glue. Thus, the inset may be reliably and easily fixed to the bag by well-established means.

The bag may be made of an autoclavable material, wherein the insert may be made of a coated cardboard or plastic material. As laboratory solid waste such as medical solid waste has to be autoclaved, the whole solid waste bag unit may be autoclaved.

The insert may be a box. Thus, the insert may be ideally designed for receiving solid waste.

According to the present disclosure, analyzer comprises an analytical device configured to use a consumable, and such a solid waste bag unit as described before.

The analyzer may further comprise a compartment, wherein the solid waste bag unit may be placed within the compartment. Thus, the solid waste bag unit of the present disclosure may be used as conventional solid waste bags not comprising an insert.

The analyzer may further comprise a casing configured to at least partially house the analytical device, wherein the compartment may be arranged within or adjacent to the casing. Thus, the solid waste be easily removed within the casing or close thereto. Accordingly, solid waste bag unit and the solid waste disposed therein is not exposed to the environment of the analyzer and any bio hazard is minimized.

The compartment may be formed substantially as a hollow block. Thus, the bag may butt against the compartment so as to maximize the reception capacity of the bag.

The block may be formed substantially cylindrical or rectangular. Thus, the block may be individually designed and adapted to the respective application with a maximum of volume.

The compartment may comprise an insertion opening through which the solid waste bag unit may be placed within the compartment. Thus, the solid waste bag unit may be easily placed within the compartment.

The compartment may be a frame. Thus, it is not necessary for the compartment to be designed as a closed entity in order to be a constructional member that provides rigidity to the solid waste bag unit.

The insert may be dimensioned to accurately fit or snug fit into the compartment. Thus, the insert may be adapted to the shape of the compartment and the complete volume of the compartment may be used for receiving solid waste.

The analyzer may further comprise a sensor configured to detect a filling state of the solid waste bag unit. Thus an overload of the solid waste bag unit may be prevented.

According to the present disclosure, a method for removing solid waste of an analyzer comprises the following steps, particularly in the given order:

a) providing a solid waste bag unit as described above,
b) placing the solid waste bag unit in a compartment of the analyzer,
c) collecting solid waste within the solid waste bag unit, and
d) removing solid waste by means of removing the solid waste bag unit from the compartment when the solid waste bag unit is at least partially filled.

The insert may be foldable, wherein the insert may be in a folded state when the solid waste bag unit is provided, wherein the method may further comprise unfolding the insert.

The insert may be unfolded when or during the solid waste bag unit is placed in the compartment.

FIG. 1 shows a perspective view of an insert 100. The insert 100 is a box 102. The insert 100 is made of a cardboard or plastic material. In one embodiment, the insert 100 is made of a coated cardboard material. The insert 100 is foldable. FIG. 1 shows the insert 100 in an unfolded state. In the unfolded state, the insert 100 is substantially ashlar-formed or rectangular with one side open as will be explained in further detail below. The insert 100 comprises a front wall portion 104, a rear wall portion 106, and two side wall portions 108. The front wall portion 104 and the rear wall portion 106 are opposing to one another in an unfolded state. Further, the two side wall portions 108 are opposing to one another in the unfolded state. The front wall portion 104 and the rear wall portion 106 are each connected to the side wall portions 108 by means of connecting wall portions 110. The side wall portions 108 may be each larger than the front wall portion 104 and the rear wall portion 106, respectively. The front wall portion 104 and the rear wall portion 106 are rectangular. The connecting wall portions 110 are triangular. The insert 100 further comprises a bottom portion 112. Thus, the insert 100 comprises an open top side 114 in the unfolded state.

Connecting lines 116 respectively formed between the front wall portion 104, the rear wall portion 106, the two side wall portions 108, the connecting wall portions 110 and the bottom portion 112 serve as folding lines. The front wall portion 104 and the rear wall portion 106 respectively comprise a recess 118. The recesses 118 are formed rectangular, polygonal or semicircular. In the exemplary embodiment shown in FIG. 1, the recesses 118 are formed semicircular.

Figure 2:
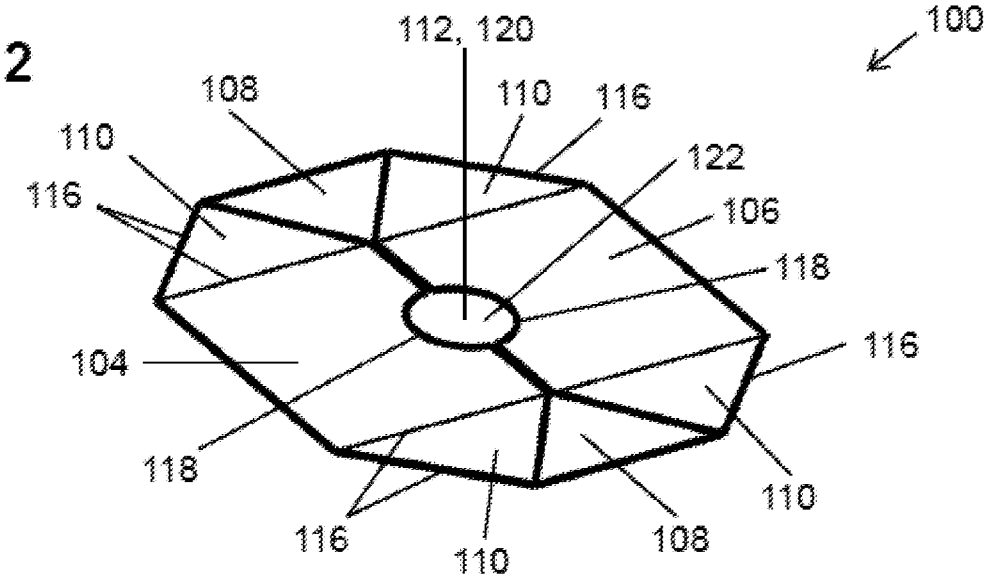
FIG. 2 shows a further perspective view of the insert.

FIG. 2 shows a further perspective view of the insert 100. Particularly, FIG. 2 shows the insert 100 in the folded state. The insert 100 is foldable by means of the connecting line 116 such that the front wall portion 104 and the rear wall portion 106 are disposed on the bottom portion 112 and the side wall portions 108 are disposed adjacent to the bottom portion 112 in a folded state. In other words, while the front wall portion 104 and the rear wall portion 106 are foldable inwards so as to be disposed on the bottom portion 112, the side wall portions 108 are foldable outwards so as to be disposed adjacent or next to the bottom portion. Thus, the insert 100 comprises a substantially flat octagonal shape in the folded state.

Figure 3:
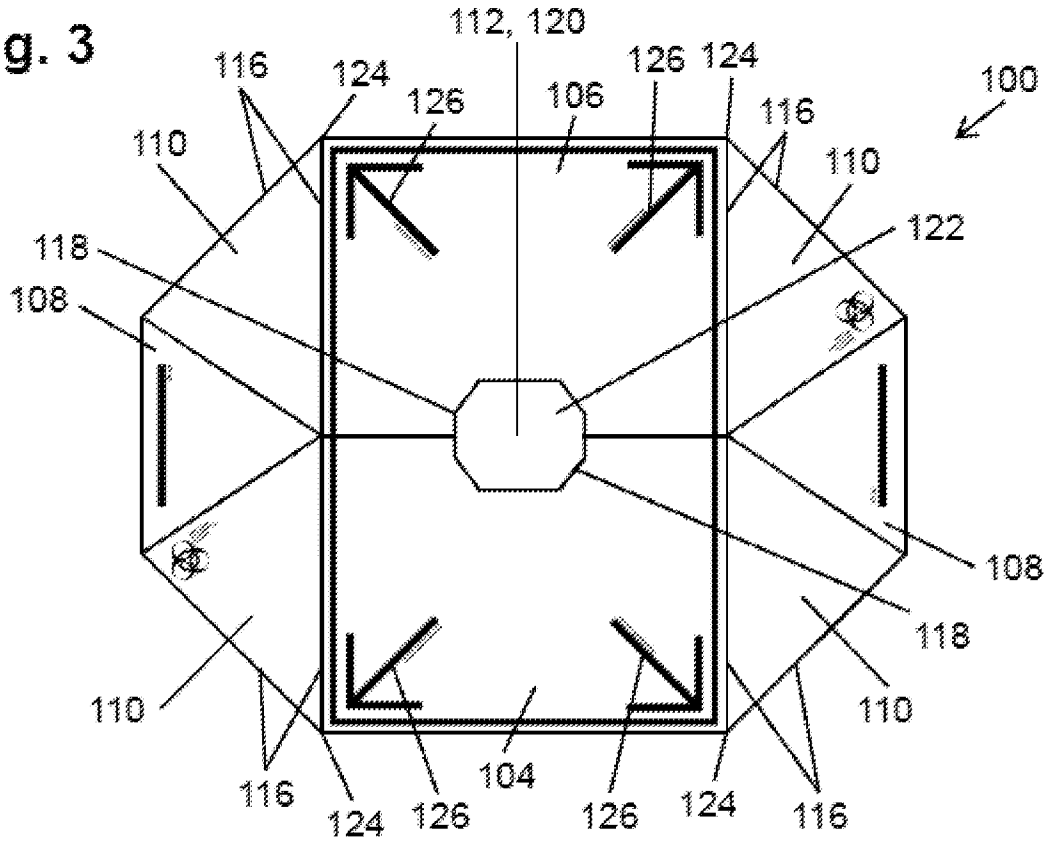
FIG. 3 shows a plan view of the insert.

FIG. 3 shows a plan view of the insert 100. Particularly, FIG. 3 shows the insert 100 in the folded state. The front wall portion 104, the rear wall portion 106 and the side wall portions 108 are moveable from a folded position to an unfolded position by means of pushing a central portion 120 of the bottom portion 112. The recesses 118 form an opening 122 in a folded state of the insert 100. The central portion 120 of the bottom portion 112 is exposed through the opening 122 in the folded state. Thus, the central portion 120 may be pushed through the opening 122, e.g. by a hand of a human person. When the central portion 120 is pushed through the opening 122, resulting forces act outwards on portions of the insert adjacent to corners 124 of the bottom portion 112 in directions indicated by arrows 126. The resulting forces cause the front wall portion 104, the rear wall portion 106 and the side wall portions 108 to move in the unfolded position as will be explained in further detail below.

Figure 4:
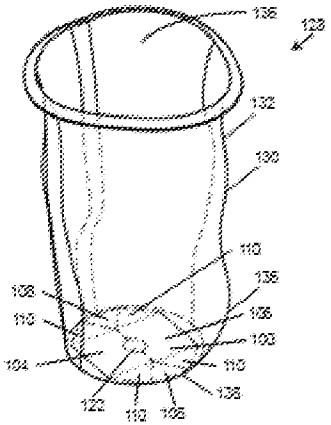
FIG. 4 shows a perspective view of a solid waste bag unit.

FIG. 4 shows a perspective view of a solid waste bag unit 128. The solid waste bag unit 128 comprises a bag 130 and the insert 100. The bag 130 is made of a flexible material.

The material of the bag 130 is autoclavable. For example, the bag 130 is made of polyethylene or polypropylene. The bag 130 comprises an upper portion 132 and a lower portion 134. The upper portion 132 comprises an opening 136. The bag 130 further comprises a bottom 138 opposing the opening 136. The insert 100 is arranged within the bag 130. Particularly, the insert 100 is arranged at the lower portion 134. More particularly, the insert 100 is arranged at the bottom 138. The insert 100 is fixed to the bag 130. The insert 100 is fixed to the bag 130 by means of glue. As the bag 130 is made of the flexible material and the insert 100 is foldable, the solid waste bag unit 128 is foldable with a minimal volume. It is to be noted that FIG. 4 shows the bag 130 in an expanded state and the insert 100 in a folded state.

Figure 5:
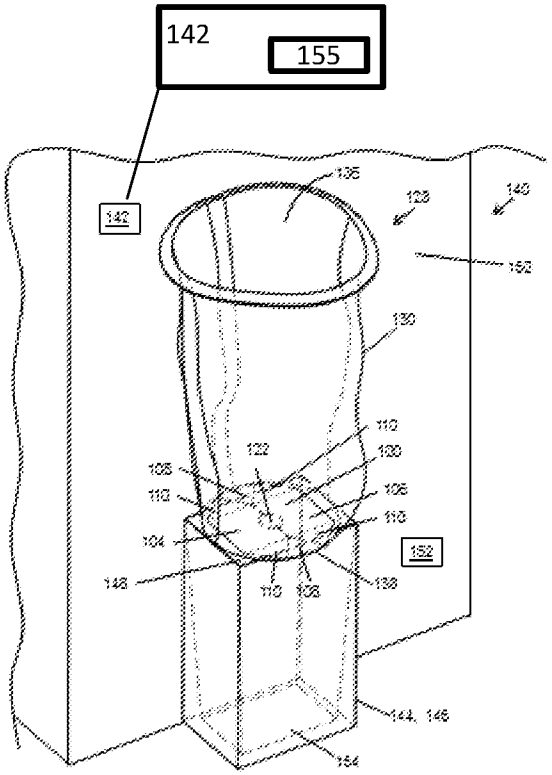
FIG. 5 shows a perspective view of an analyzer.

FIG. 5 shows a perspective view of an analyzer 140. The analyzer 140 comprises an analytical device 142 configured to use a consumable (not shown in detail) and the solid waste bag unit 128. The analytical device 142 may comprises a sample processing device 155 by means of which a sample may be processed, e.g. prepared and analyzed, and a pipetting device by means of which the sample may be pipetted. Thus, the consumable may be a pipetting tip or a rack in which the sample vessels including the samples are provided. The analyzer 140 further comprises a compartment 144. The compartment 144 is formed substantially as a hollow block 146. Particularly, the block 146 is formed substantially cylindrical or rectangular. For example, the compartment 144 is a frame. The solid waste bag unit 128 is placed within the compartment 144. For this purpose, the compartment 144 comprises an insertion opening 148 through which the solid waste bag unit 128 is placed within the compartment. 144. The insert 100 is dimensioned to accurately fit or snug fit into the compartment 144. The analyzer 140 further comprises a casing 150 configured to at least partially house the analytical device 142. The compartment 144 is arranged within or adjacent to the casing 150. Optionally, the analyzer 140 may further comprise a sensor 152 configured to detect a filling state of the solid waste bag unit 128. The sensor 152 may be an optical sensor configured to detect the filling state. For example, the optical sensor may be connected to a light barrier detecting a predetermined level of the solid waste within the solid waste bag unit 128. For this purpose, the bag 130 may be transparent so as to allow light to propagate through the bag 130. Alternatively, the sensor 152 may be a weight sensor detecting the filling state by means of the weight of the solid waste bag unit 128 and the solid waste included therein. FIG. 5 shows the solid waste bag unit 128 immediately before being placed within the compartment 144. In this state, the bag 130 is expanded while the insert 100 is in the folded state. The solid waste bag unit 128 is disposed with the bottom 138 thereof at the insertion opening 148 of the compartment 144.

Figure 6:
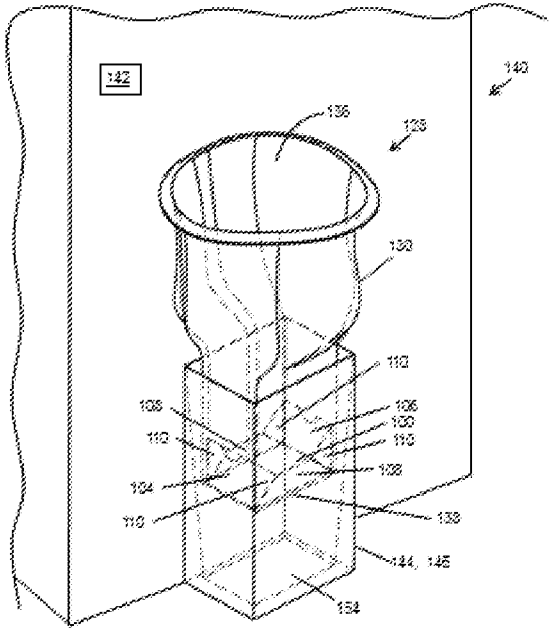
FIG. 6 shows a further perspective view of the analyzer.

FIG. 6 shows a further perspective view of the analyzer 140. Particularly, FIG. 6 shows the solid waste bag unit 128 during a process of being placed within the compartment 144. Thus, the solid waste bag unit 128 is moved into the compartment 144 through the insertion opening 148, e.g. by an operator of the analyzer 140. During insertion process, the central portion 120 is pushed through the opening 122, e.g. by a hand of the operator. Thereby, the bottom portion 112 is pressed further downwards in the insertion direction than the front wall portion 104, the rear wall portion 106 and the side wall portions 108. As the bag 128 abuts an inner surface of the compartment 144, frictional forces act thereon. The forces resulting from the pushing force and the frictional forces act outwards on portions of the insert 100 adjacent to the corners 124 of the bottom portion 112 in the directions indicated by arrows 126. The resulting forces cause the front wall portion 104, the rear wall portion 106 and the side wall portions 108 to move in the unfolded position as these straighten up as shown in FIG. 6. The solid waste bag unit 128 is then completely placed within the compartment 144. In this state, the bottom 138 of the bag 128 contacts a bottom 154 of the compartment 144.

The placing of the solid waste bag unit 128 within the compartment 144 may be part of a method for removing solid waste of the analyzer 140. With this method, the solid waste bag unit 128 is provided with the insert 100 being in the folded state and placed within the compartment 144 as described above. When the solid waste bag unit 128 is placed within the compartment 144, the insert 100 is unfolded as described above. Then the analytical device 142 is ready to be used and solid waste may be collected within the solid waste bag unit 128. When the solid waste bag unit 128 is at least partially filled, the solid waste may be removed from the analyzer 140 by means of removing the solid waste bag unit 128 from the compartment 144. For this purpose, the solid waste bag unit 128 is moved in a direction opposite to the direction in which the solid waste bag unit 128 is inserted in the compartment 144. Subsequently, the solid waste bag unit 128 including the solid waste may be autoclaved.

The present application is not to be limited in scope by the specific embodiments described herein. Indeed, various modifications in addition to those described herein will become apparent to those skilled in the art from the foregoing description and accompanying figures. Such modifications are intended to fall within the scope of the claims. Various publications are cited herein, the disclosures of which are incorporated by reference in their entireties.

LIST OF REFERENCE NUMBERS

100 insert
102 box
104 front wall portion
106 rear wall portion
108 side wall portion
110 connecting wall portion
112 bottom portion
114 top side
116 connecting line
118 recess
120 central portion
122 opening
124 corner
126 arrow
128 solid waste bag unit
130 bag
132 upper portion
134 lower portion
136 opening
138 bottom
140 analyzer
142 analytical device
144 compartment
146 block
148 insertion opening
150 casing
152 sensor
154 Bottom

The invention claimed is:

1. An analyzer comprising:

a) an analytical device comprising a sample processing device;

b) a solid waste bag unit including a bag comprising an autoclavable material, and a foldable insert arranged within the bag, wherein the insert is made of a cardboard or plastic material and comprises a front wall portion, a rear wall portion, two side wall portions, and a bottom portion, the front and rear wall portions are connected to each of the two side wall portions by connecting wall portions, and the insert houses laboratory solid waste generated by the analyzer; and c) a compartment sized to fit the solid waste bag unit.

2. An analyzer according to claim 1, wherein the bag is made of a flexible material.

3. An analyzer according to claim 2, wherein the insert is foldable such that the solid waste bag unit is foldable with a minimal volume.

4. An analyzer according to claim 1, wherein the bag comprises an upper portion and a lower portion, wherein the upper portion comprises an opening, wherein the insert is arranged at the lower portion.

5. An analyzer according to claim 1, wherein the insert is fixed to the bag.

6. An analyzer according to claim 1, wherein the insert is dimensioned to accurately fit or snug fit into the compartment.

* * * * *